United States Patent [19]

Yamamoto et al.

[11] 4,341,043

[45] Jul. 27, 1982

[54] WEATHERTIGHT SLIDING SASH WINDOW ASSEMBLY

[75] Inventors: Yukio Yamamoto; Takeo Uehara, both of Uozu, Japan

[73] Assignee: Yoshida Kogyo K.K., Tokyo, Japan

[21] Appl. No.: 177,402

[22] Filed: Aug. 12, 1980

[30] Foreign Application Priority Data

Aug. 16, 1979 [JP] Japan ..... 54-103542

[51] Int. Cl.[3] ..... E05D 13/04

[52] U.S. Cl. ..... 49/449; 49/209; 49/225

[58] Field of Search ..... 49/449, 209, 225, 216, 49/217, 221, 222

[56] References Cited

U.S. PATENT DOCUMENTS 1,950,311 3/1934 Leghart ..... 49/449 X
3,078,524 2/1963 Minick ..... 49/449
3,538,642 11/1970 Fredricksen ..... 49/225 X
4,114,317 9/1978 Crawley ..... 49/209

*Primary Examiner*—Philip C. Kannan
*Attorney, Agent, or Firm*—Bucknam and Archer

[57] ABSTRACT

A weathertight sash window assembly including a pair of first and second engaging members disposed on and extending longitudinally of a pair of meeting first and second stiles, respectively. The first engaging member is movable between a first position in which the first engaging member pulls or draws the second engaging member toward the interior of the window assembly to force the second stile firmly on to the first stile throughout their length and a second position in which the first engaging member releases the second engaging member to allow the second stile off the first stile. The sash window assembly further includes means on the first stile for moving the first engaging member between the first and second positions in response to movement of a first fastener member between its locked and unlocked positions.

7 Claims, 8 Drawing Figures

WEATHERTIGHT SLIDING SASH WINDOW ASSEMBLY

BACKGROUND OF THE INVENTION

1. Field of the Invention

The present invention relates to sash windows, and more particularly to improvements in weatherproofing for sashes of a sliding window.

2. Prior Art

In order to make a sliding window weatherproof against rain and wind, it has been a very common practice to bring two sashes of the sliding window firmly together at the meeting stiles by means of a catch or fastener. The catch includes a hooked arm fixed on one of the meeting stiles and a crescent arm pivotable on the other stile; the hooked arm rides on the crescent arm to produce a clenching effect. However, the catch is usually disposed just at the centre of the meeting stiles, and hence such a clenching effect could not extend to the whole length of the meeting stiles. With such prior sash window only insufficient weatherproofing can be achieved.

SUMMARY OF THE INVENTION

It is therefore an object of the present invention to provide a weathertight sliding sash window assembly in which a clenching effect of a catch can extend to the whole length of the meeting sash stiles uniformly, making the sash window weatherproof against heavy rain and wind.

According to the present invention, a weathertight sliding sash window assembly includes a pair of first and second engaging members disposed on and extending longitudinally of a pair of meeting first and second stiles, respectively, the first engaging member being movable between a first position in which the first engaging member pulls or draws the second engaging member toward the interior of the window assembly to force the second stile firmly on to the first stile throughout their length and a second position in which the first engaging member releases the second engaging member to allow the second stile off the first stile. The sash window assembly further includes means on the first stile for moving the first engaging member between the first and second positions in response to a first fastener member's movement between its locked and unlocked positions.

Many other advantages, features and additional objects of the present invention will become manifest to those versed in the art upon making reference to the detailed description and the accompanying drawings in which preferred embodiments incorporating the principles of the present invention are shown by way of illustrative example.

BRIEF DESCRIPTION OF THE DRAWINGS

The same reference numerals denote similar parts throughout other views.

DETAILED DESCRIPTION OF THE PREFERRED EMBODIMENTS

Figure 1:
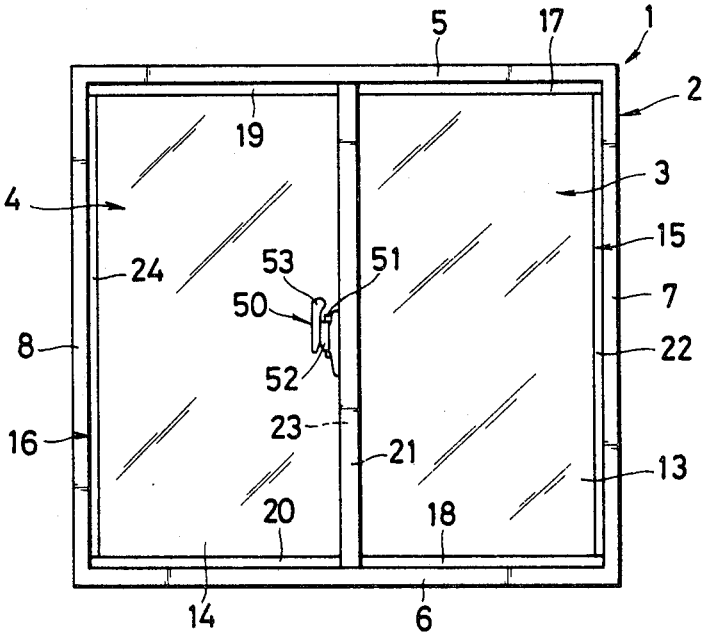
FIG. 1 is a front elevational view of a weathertight sliding sash window assembly embodying the present invention.
Figure 2:
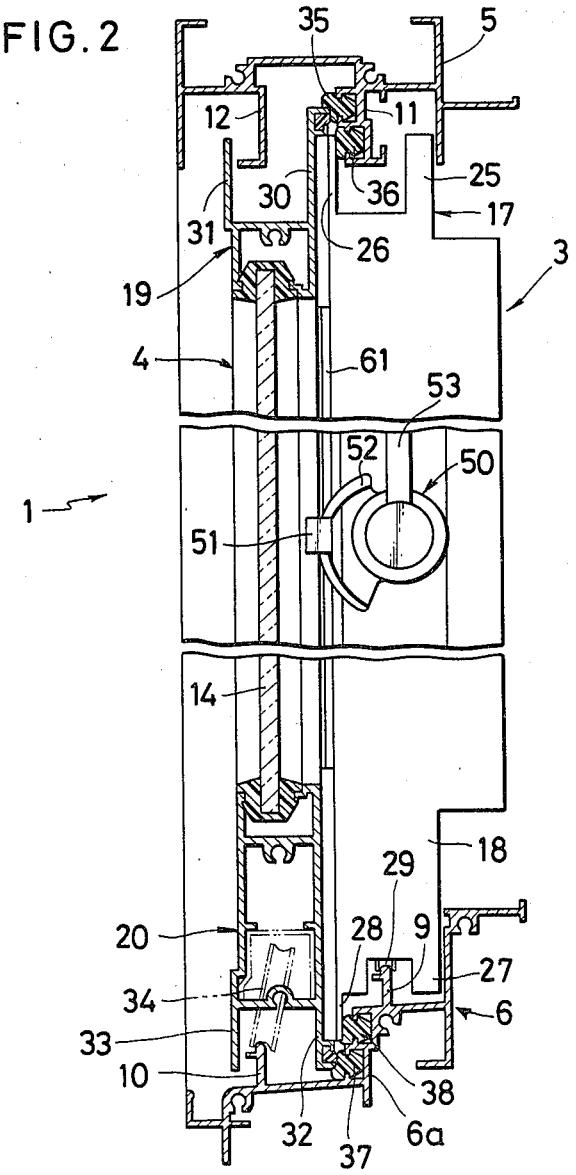
FIG. 2 is an enlarged vertical cross-sectional view of the sash window assembly of FIG. 1.
Figure 3:
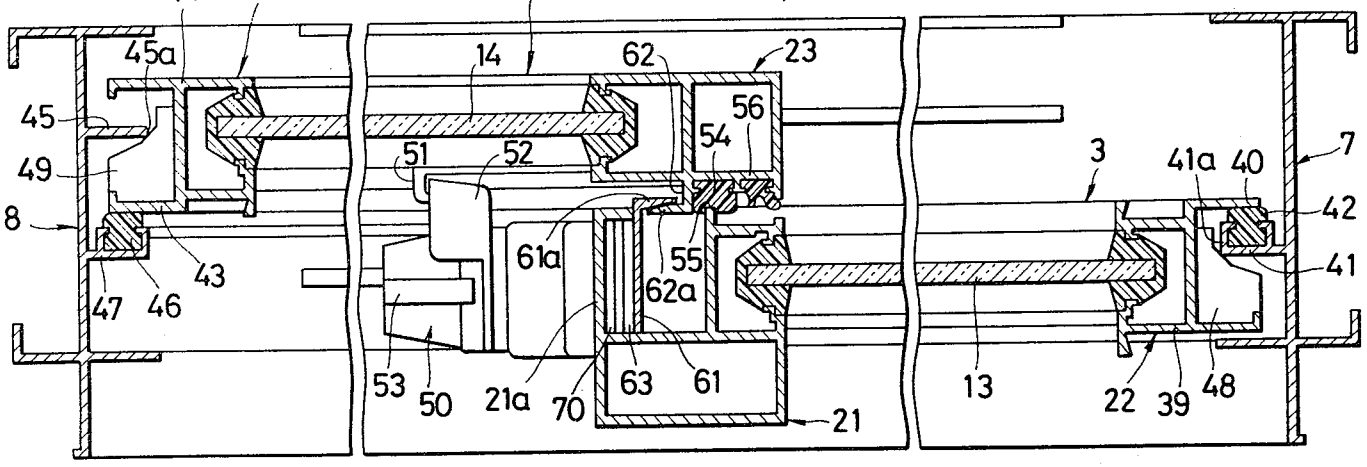
FIG. 3 is an enlarged horizontal cross-sectional view of the sash window assembly of FIG. 1.

The principles of the present invention are particularly useful when embodied in a weathertight sliding sash window assembly such as shown in FIGS. 1 to 3, generally indicated by the numeral 1. The window assembly 1 comprises an outer frame 2 adapted to be mounted within an opening in a building wall (not shown) and defining a window opening, and a pair of relatively horizontally movable, overlapping interior and exterior sashes 3, 4 mounted within the outer frame 2 in parallel, closely spaced planes.

The outer frame 2 includes a header 5, a sill 6, and a pair of side jambs 7,8 connected to the header and sill 5,6 at their ends. As shown in FIG. 2, the sill 6 is shaped into a series of longitudinally elongated steps progressively decreasing in height toward the exterior of the window assembly 1, which is the left side as illustrated in this Figure. The sill 6 includes a pair of parallel spaced bottom rails 9,10 coextending with the steps. The header 5 includes a pair of top rails 11, 12 downwardly projecting therefrom. The top rails 11,12 are substantially, vertically aligned with the bottom rails 9,10, respectively. The interior and exterior sashes 3,4 are horizontally slidably supported between the top and bottom rails 11,9 and between the top and bottom rails 12,10 respectively.

Each of the interior and exterior sashes 3,4 includes a pane of glass 13,14 and an inner frame 15,16 (FIG. 1) extending along and embracing the periphery of the pane 13,14. Each inner frame 15,16 includes a pair of upper and lower horizontal frame members 17,18;19,20 (FIGS. 1 and 2) and a pair of inner and outer vertical frame members or stiles 21,22;23,24 (FIGS. 1 and 3).

As shown in FIG. 2, the upper and lower horizontal frame members 17,18 of the interior sash 3 have a pair of parallel spaced, upwardly directed interior and exterior plates 25,26 and a pair of parallel spaced, downwardly directed interior and exterior plates 27,28, respectively. Supported between the interior and exterior plates 27,28 are a plurality of grooved wheels 29 (only one of which is shown) which ride on the bottom rail 9. The top rail 11 projects into a space between the interior and exterior plates 25,26. Similarly, the upper and lower horizontal frame members 19,20 of the exterior sash 4 have a pair of parallel spaced, upwardly directed interior and exterior plates 30,31 and a pair of parallel spaced, downwardly directed interior and exterior plates 32,33, respectively. Supported between the interior and exterior plates 32,33 are a plurality of grooved wheels 34 (only one of which is shown) which ride on the bottom rail 10. The top rail 12 projects into a space between the interior and exterior plates 30,31.

A pair of first and second horizontal weatherstrips 35,36 (FIG. 2) are carried on and along the top rail 11 and are engageable with the interior plate 30 of the upper horizontal frame member 19 and the exterior plate 26 of the upper horizontal frame member 17, respectively, when the interior and exterior sashes 3,4 are forced toward the interior of the window assembly 1, which is the right side as illustrated in FIG. 2.

Similarly, a pair of third and fourth horizontal wheather-strips 37,38 (FIG. 2) are carried on and along an upstanding riser 6*a* of the sill 6 and are engageable with the interior plate 32 of the lower horizontal frame member 20 and the exterior plate 28 of the lower horizontal frame member 18, respectively.

As shown in FIG. 3, the outer stile 22 of the interior sash 3 has a pair of parallel spaced outwardly (rightwardly) directed interior and exterior plates 39,40. Projecting into a space between the interior and exterior plates 39,40 is a first vertical rail 41 on the side jamb 7. A first vertical weatherstrip 42 is carried on and along the first vertical rail 41 and is engageable with the exterior plate 40 of the outer stile 22 when the interior sash 3 is forced toward the interior of the window assembly 1 (downwardly as illustrated in FIG. 3).

The outer stile 24 of the exterior sash 4 has a pair of parallel spaced, outwardly directed interior and exterior plates 43,44. Projecting into a space between the interior and exterior plates 43,44 is a second vertical rail 45 on the side jamb 8. A second vertical weatherstrip 46 is carried on and along a third vertical rail 47 on the side jamb 8 and is engageable with the interior plate 43 of the outer stile 24 when the exterior sash 4 is forced toward the interior of the window assembly 1.

On the outer stile 22 of the interior sash 3 there is a first cam 48 on which an edge 41*a* of the first vertical rail 41 rides so that the outer stile 22 is moved toward the interior of the window assembly 1 when the interior sash 3 is urged outwardly (rightwardly), as described below. Similarly, on the outer stile 24 of the exterior sash 4 there is a second cam 49 on which an edge 45*a* of the second vertical rail 45 rides so that the outer stile 24 is moved toward the interior of the window assembly 1 when the exterior sash 4 is urged outwardly (leftwardly), as described below.

At the centre of the meeting (inner) stiles 21,23 there is a catch or fastener 50 (FIGS. 1 to 4) comprising a hooked arm 51 fixed on the inner stile 23 and a crescent arm 52 pivotable on the inner stile 21, the crescent arm 52 having a handle 53 formed integrally therewith. The crescent arm 52 is angularly movable between a locked position (FIGS. 1 to 3) in which the crescent arm 52 engages the hooked arm 51 to keep the interior and exterior sashes 3,4 fully closed and an unlocked position (FIG. 4) in which the crescent arm 52 releases the hooked arm 51 to permit the interior and exterior sashes 3,4 to be opened. As the crescent arm 52 is in the locked position, the hooked arm 51 rides on the crescent arm 52 to produce a clenching effect, as well known in the art, forcing the interior and exterior sashes 3,4 outwardly, i.e. rightwardly and leftwardly, respectively, as illustrated in FIG. 3.

Figure 4:
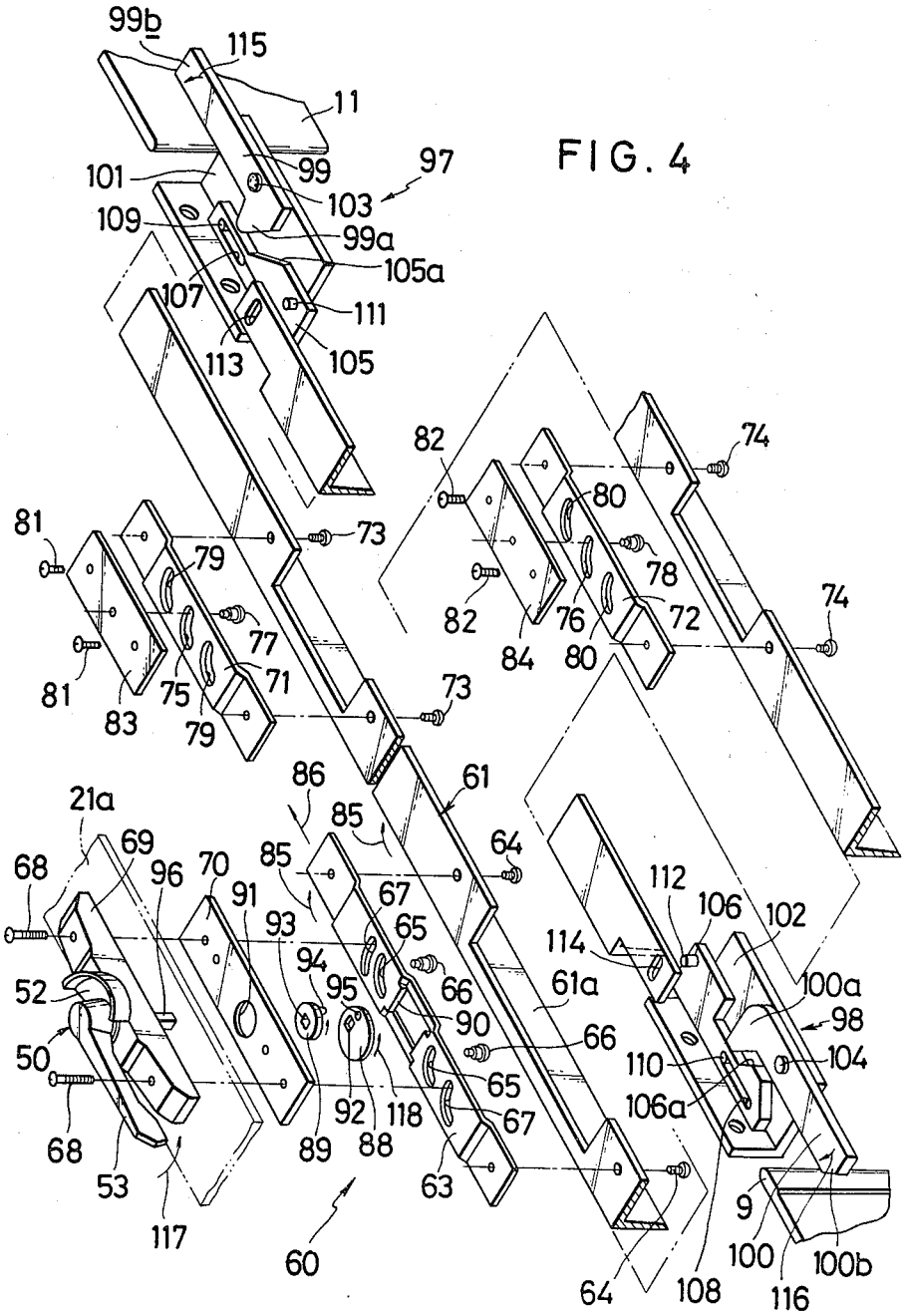
FIG. 4 is an enlarged, exploded perspective view of a sash pulling or drawing mechanism of the window assembly shown in FIGS. 1 to 3.

A third vertical weatherstrip 54 (FIG. 3) is carried on and along an interior plate 56 of the inner stile 23 and is engageable with an exterior surface 55 of the inner stile 21 when the inner stile 23 is forced toward the interior of the window assembly 1 (downwardly as illustrated in FIG. 3) by a mechanism such as shown in FIG. 4, generally indicated by the numeral 60.

The mechanism 60 comprises a first engaging member 61 slidably supported on and extending longitudinally of the inner stile 21 of the interior sash 3 and a second engaging member 62 (FIG. 3) formed integrally with and extending longitudinally of the inner stile 23 of the exterior sash 4, the first engaging member 61 being engageable with the second engaging member 62. Each of the first and second engaging members 61,62 is in the form of an elongate angled plate having an L-shaped transverse cross section, such two angled plates 61,62 being wedge-shaped at their operative edges 61*a*,62*a* (FIG. 2). The first engaging member 61 is movable between a first position (FIG. 3) in which the first engaging member 61 pulls or draws the second engaging member 62 toward the interior of the window assembly 1 to force the inner stile 23 firmly on to the inner stile 21 throughout their length and a second position (not shown) in which the first engaging member 61 releases the second engaging member 62 to allow the inner stile 23 off the inner stile 21.

A first auxiliary plate 63 is attached to the first engaging member 61 at the centre thereof by a pair of screws 64,64. The first auxiliary plate 63 has a pair of first arcuate slots 65,65 through which a pair of headed guide pins 66,66 loosely extend, respectively, and a pair of second arcuate slots 67,67 through which a pair of screws 68,68 loosely extend, respectively.

The screws 68,68 extend threadedly through a mount 69 for the crescent arm 52, a side plate 21*a* of the inner stile 21, and a support plate 70 on which the headed guide pins 66,66 are fixed. A pair of second auxiliary plates 71,72 are attached to the first engaging member 61 by means of screws 73,74 and spaced remotely from each other as well as from the first auxiliary plate 63 along the first engaging member 61. Each of the second auxiliary plates 71,72 has a first arcuate slot 75,76 through which a headed guide pin 77,78 loosely extends, and a pair of second arcuate slots 79,79;80,80 through which a pair of screws 81,81;82,82 loosely extend, respectively. The screws 81,81 extend threadedly through the side plate 21*a* and a support plate 83 on which the headed guide pin 77 is fixed. Similarly, the screws 82,82 extend threadedly through the side plate 21*a* and a support plate 84 on which the headed guide pin 78 is fixed. This guide means makes the first engaging member 61 capable of being moved in the direction of arrows 85, i.e. toward the interior of the window assembly 1, as the first engaging member 61 is urged in the direction of arrow 86, i.e. upwardly.

The mechanism 60 further comprises means for urging the first engaging member 61 upwardly and downwardly in response to pivotal movement of the handle 53. This means includes a pair of first and second circular plates 88,89 rotatably received in an opening 90 of the first auxiliary plate 63 and an opening 91 of the support plate 70, respectively. The first circular plate 88 has a rectangular opening 92 at eccentric position, and the second circular plate 89 has a rectangular opening 93 at the centre, the second circular plate 89 having a pin 94 projecting into a hole 95 in the first circular plate 88. A shaft 96 having a rectangular cross section is connected to the crescent arm 52 coaxially therewith and extends through the opening 93 in the second circular plate 89 and the opening 92 in the first circular plate 88. Since the first circular plate 88 is mounted on the shaft 96 eccentrically thereof, the first circular plate 88 functions as a cam, urging the first engaging member 61 upwardly and downwardly in response to pivotal movement of the crescent arm 52 between its locked and unlocked positions.

In order to move the inner stile 21 toward the interior of the window assembly 1 simultaneously with pivotal movement of the crescent arm 52 from its unlocked position to its locked position, there is means 97,98 at each end of the inner stile 21. Each means 97,(98) includes a pushing lever 99 (100) pivotably supported on a bracket 101 (102) by a pin 103 (104), and a cam plate 105 (106) slidably supported on the bracket 101 (102). The brackets 101, (102) are fixed to the inner stile 21. The cam plate 105 (106) has a longitudinal slot 107 (108) into which a pin 109 (110) on the bracket 101 (102) loosely extends. A pin 111 (112) on the cam plate 105 (106) is loosely extended into a transverse slot 113 (114) in the first engaging member 61. As the first engaging member 61 is moved upwardly, the cam plate 105 (106) slides upwardly so that one end 99*a* (100*a*) of the pushing lever 99 (100) rides on a cam portion 105*a* (106*a*), causing the pushing lever 99 (100) to pivot in the direction of arrows 115 (116) to push by the other end 99*b* (100*b*) the top rail 11 (bottom rail 9), which are stationary. As a result, the inner stile 21 of the interior sash 3 is forced toward the interior of the window assembly 1.

In operation, as the handle 53 is turned in the direction of arrow 117 (FIG. 4) from the position of FIG. 4 to that of FIGS. 1 to 3, the crescent arm 52 is angularly moved to engage the hooked arm 51, keeping the interior and exterior sashes 3,4 in their fully closed positions. With the crescent arm 52 moved to locked position, the hooked arm 51 rides on the crescent arm 52 to produce a clenching effect, forcing the interior and exterior sashes 3,4 outwardly, i.e. rightwardly and leftwardly, respectively, as illustrated in FIG. 3. The rightwardly forced interior sash 3 is moved at the outer stile 22 toward the interior of the window assembly 1 by the action of the first cam 48, bringing the exterior plate 40 of the outer stile 22 into engagement with the first vertical weatherstrip 42, as shown in FIG. 3. Similarly, the leftwardly forced exterior sash 4 is moved at the outer stile 24 toward the interior by the action of the second cam 49, bringing the interior plate 43 of the outer stile 24 into engagement with the second vertical weatherstrip 46.

In response to such pivotal movement of the handle 53, the first circular plate 88 angularly moves in the direction of arrow 118 (FIG. 4), urging the first engaging member 61 upwardly. The upwardly urged first engaging member 61 is moved toward the interior of the window assembly 1 by the slot-and-pin guide, pulling or drawing the second engaging member 62 toward the interior of the window assembly 1. The inner stile 23 is thereby forced firmly on to the inner stile 21 throughout their length. As a result, the exterior surface 55 of the inner stile 21 is brought into engagement with the fourth vertical weatherstrip 54 (FIG. 3). The interior plate 30 of the upper horizontal frame member 19 and the interior plate 32 of the lower horizontal frame member 20, both on the exterior sash 4, are brought into engagement with the first and third horizontal weatherstrips 35,37 respectively (FIG. 2).

Simultaneously, at each end of the inner stile 21, the cam plate 105 (106) is pulled upwardly by the first engaging member 61 so that one end 99*a* (100*a*) of the pushing lever 99 (100) rides on the cam portion 105*a* (106*a*), causing the pushing lever 99 (100) to pivot in the direction of arrows 115 (116) (FIG. 4) to push by the other end 99*b* (100*b*) the top rail 11 (bottom rail 9). The inner stile 21 of the interior sash 3 is thereby forced toward the interior of the window assembly 1. As a result, the exterior plate 26 of the upper horizontal frame member 17 and the exterior plate 28 of the lower horizontal frame member 18, both on the interior sash 3, are brought into engagement with the second and fourth horizontal weatherstrips 36,38, respectively (FIG. 2).

Figure 5:
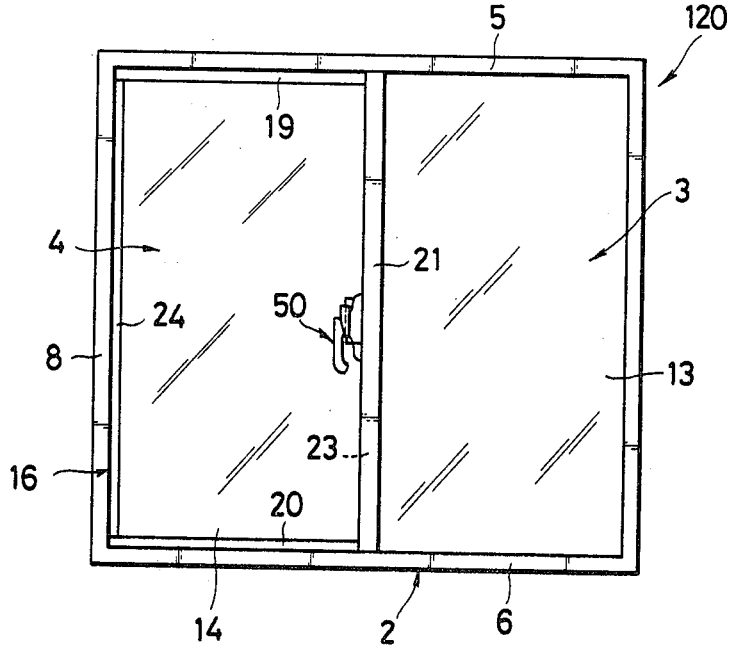
FIG. 5 is a view similar to FIG. 1, but showing a modified form of weathertight sliding sash window assembly.
Figure 6:
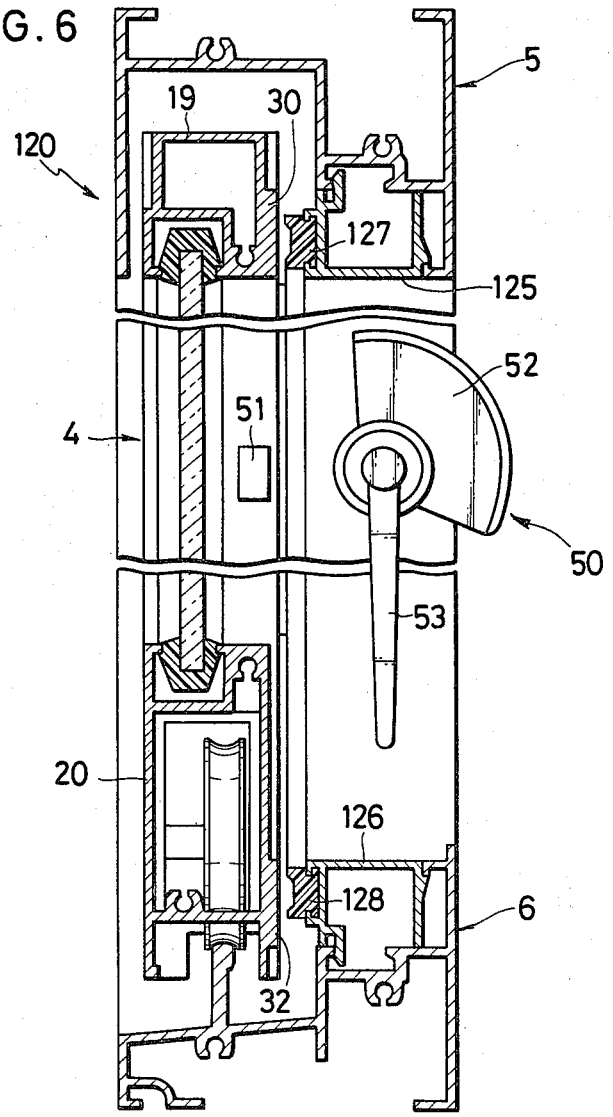
FIG. 6 is an enlarged vertical cross-sectional view of the sash window assembly of FIG. 5.
Figure 7:
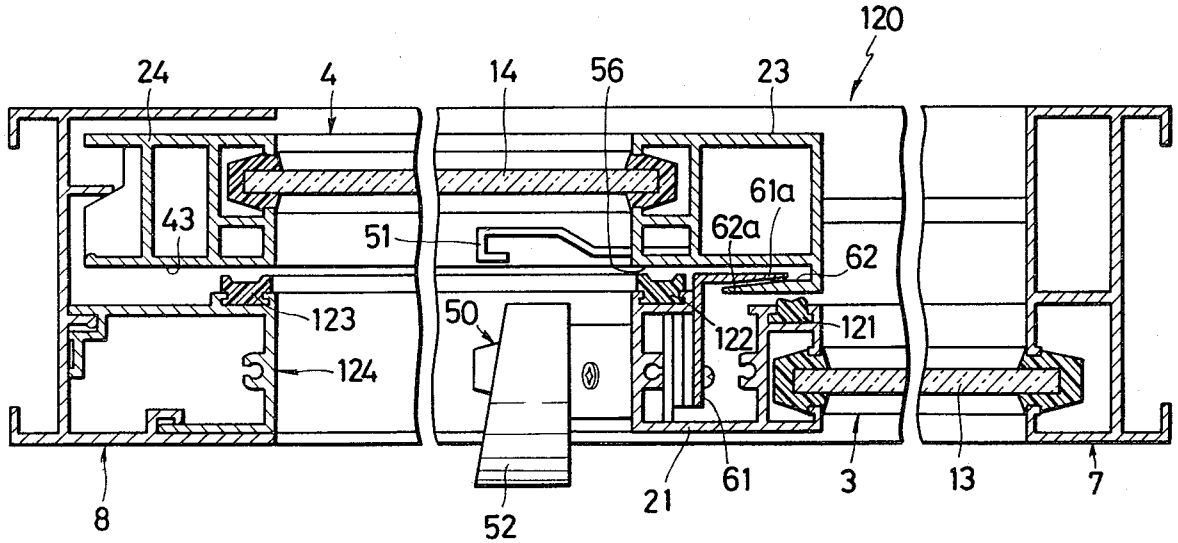
FIG. 7 is an enlarged horizontal cross-sectional view of the sash window assembly of FIG. 5.
Figure 8:
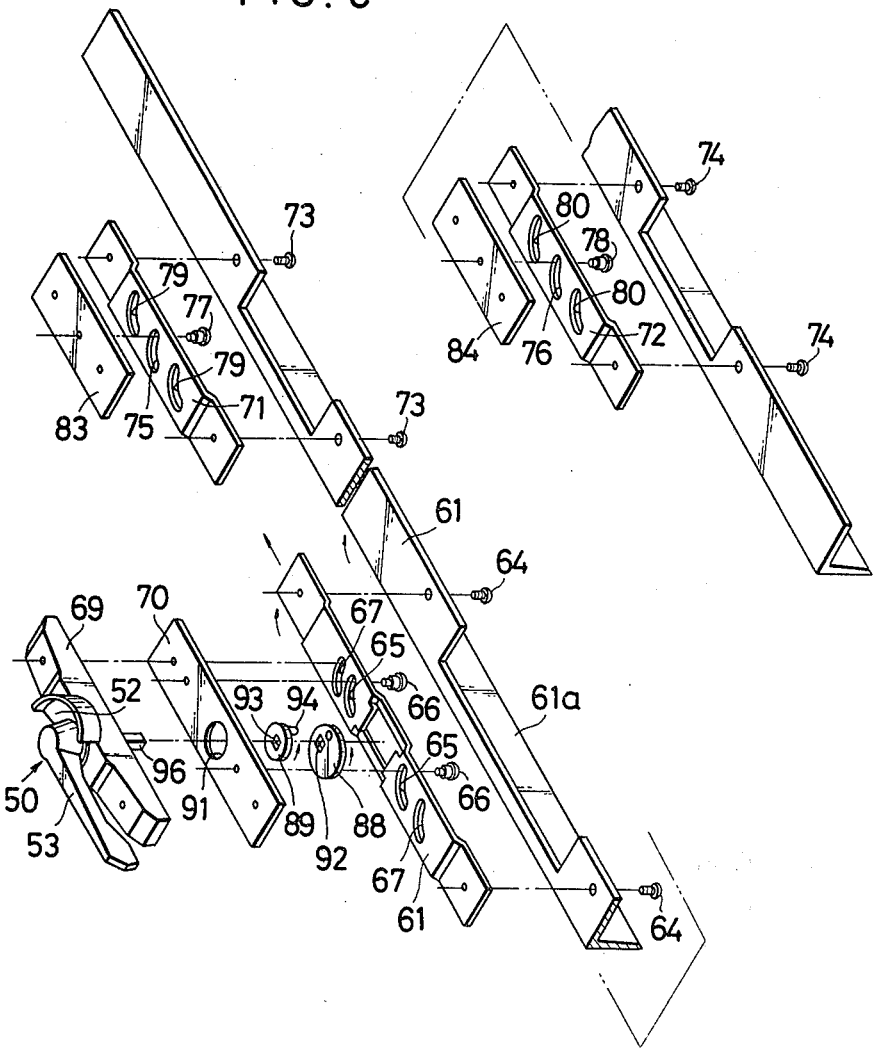
FIG. 8 is an enlarged, exploded perspective view of a sash pulling or drawing mechanism of the window assembly shown in FIGS. 5 to 7.

FIGS. 5 to 7 illustrate a modified weathertight sliding sash window assembly 20 in which the interior sash 3 is fixed to the outer frame 2 and hence the interior-sash moving means 97, 98 (FIG. 4) is omitted as illustrated in FIG. 8. In FIG. 7, a pair of vertical weatherstrips 121,122 are carried by the inner stile 21 and are engageable with the interior plate 56 of the inner stile 23 and the second engaging member 62, respectively. A further vertical weatherstrip 123 is carried on and along a vertical batten 124 and is engageable with the interior plate 43 of the outer stile 24. As shown in FIG. 6, a pair of upper and lower horizontal battens 125,126 are mounted on the header 5 and sill 6 at the interior side. A pair of horizontal weatherstrips 127,128 are carried on and along the upper and lower horizontal battens 125,126, respectively, and are engageable with the interior plate 30 of the upper horizontal frame member 19 and the interior plate 32 of the lower horizontal frame member 20, respectively.

With any one of the embodiments a clenching effect of the catch or fastener can be extended to the whole length of the meeting stiles uniformly, making the sash window weatherproof against heavy rain and wind.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A weathertight sliding sash window assembly comprising:

(a) an outer frame defining a window opening;

(b) a pair of relatively movable, overlapping interior and exterior sashes mounted within said outer frame for opening and closing said window opening, said interior and exterior sashes having a pair of meeting first and second stiles, respectively;

(c) a pair of mating first and second fastener members mounted on said first and second stiles at respective midportions thereof, said first fastener member being movable between a locked position in which said first fastener member engages said second fastener member to keep said interior and exterior sashes closed and an unlocked position in which said first fastener member releases said second fastener member to be opened;

(d) a pair of first and second engaging members disposed on and extending longitudinally of said first and second stiles, respectively, said first engaging member being movable between a first position in which said first engaging member pulls said second engaging member interiorly to force said second stile firmly on to said first stile throughout their lengths and a second position in which said first engaging member releases said second engaging member to allow said second stile off said first stile; and (e) means on said first stile for moving said first engaging member between said first and second positions in response to said first fastener member's movement between said locked and unlocked positions.

2. A weathertight sliding sash window assembly according to claim 1, each of said first and second engaging members including an elongate angled plate having an L-shaped transverse cross section.

3. A weathertight sliding sash window assembly according to claim 1, said first and second fastener members including a crescent arm pivotable on said first stile and a hooked arm fixed on said second stile, respectively.

4. A weathertight sliding sash window assembly according to claim 2, said first-engaging-member moving means including a camshaft connected to said first fastener member coaxially of said crescent arm, a cam plate mounted on said camshaft for urging said first engaging member longitudinally thereof in response to pivotal movement of said crescent arm, and means for guiding said first engaging member between said first and second positions when said first engaging member is urged longitudinally thereof.

5. A weathertight sliding sash window assembly according to claim 4, said guiding means including a plurality of arcuate slots in said first engaging member and a plurality of guide pins fixed to said first stile, each of said guide pins extending through one of said arcuate slots.

6. A weathertight sliding sash window assembly according to claim 4, further comprising means on opposite ends of said first stile for forcing said first stile interiorly in response to longitudinal movement of said first engaging member.

7. A weathertight sliding sash window assembly according to claim 6, the last-named means at each end of said first stile including a pushing lever pivotably supported on said first stile for pushing said outer frame so as to move said first stile interiorly, and a cam plate supported on said first stile and slidable, in response to longitudinal movement of said first engaging member, for causing said pushing lever to pivot.

* * * * *